US006935927B2

(12) United States Patent
Ashizawa

(10) Patent No.: US 6,935,927 B2
(45) Date of Patent: Aug. 30, 2005

(54) BLASTING METHOD FOR DEBURRING JUNCTION PART BETWEEN MAIN BORE AND BRANCH BORE

(75) Inventor: Hirotaka Ashizawa, Numazu (JP)

(73) Assignee: Fuji Seiki Machine Works Ltd., Shizuoka-Pref. (JP)

( * ) Notice: Subject to any disclaimer, the term of this patent is extended or adjusted under 35 U.S.C. 154(b) by 0 days.

(21) Appl. No.: 10/441,535

(22) Filed: May 20, 2003

(65) Prior Publication Data

US 2003/0232577 A1 Dec. 18, 2003

(30) Foreign Application Priority Data

Jun. 18, 2002 (JP) ..... 2002-176762

(51) Int. Cl.[7] ..... B24B 1/00

(52) U.S. Cl. ..... 451/36; 451/39; 451/40; 451/51

(58) Field of Search ..... 457/36, 39, 38, 457/40, 57; 134/7, 12, 22; 15/3, 57; 451/38, 40, 51, 36, 39; 137/240; 156/153

(56) References Cited

U.S. PATENT DOCUMENTS 3,299,459 A * 1/1967 McCune ..... 15/3.51
4,380,477 A * 4/1983 Saunders ..... 134/7
4,931,120 A * 6/1990 Christoff ..... 156/153
5,085,244 A * 2/1992 Funk ..... 137/240
5,160,548 A * 11/1992 Boisture ..... 134/7
5,195,276 A * 3/1993 Vennerholm ..... 451/39
5,375,378 A * 12/1994 Rooney ..... 451/38
5,885,133 A * 3/1999 Williams, Jr. ..... 451/40
6,047,714 A * 4/2000 Akazawa ..... 134/22.12
6,315,639 B1 * 11/2001 Kipp ..... 451/38
6,503,126 B1 * 1/2003 Rhoades ..... 451/36
6,540,589 B1 * 4/2003 Thiem et al. ..... 451/36

OTHER PUBLICATIONS

Metal Finishing News, "*Electronics Inc. & MFN's Official Shot Peening Training Made Available to the Industry*!", vol. 3, May Issue, Year 2002, pp. 20–21.

* cited by examiner

*Primary Examiner*—George Nguyen
(74) *Attorney, Agent, or Firm*—Flynn, Thiel, Boutell & Tanis, PC

(57) ABSTRACT

A method of a blast process for a junction part between a large-diameter main bore tubularly drilled through an article and a small-diameter branch bore branching off at an angle from the main bore inside the article. A pillar-shaped rod is inserted from a first open end of the main bore to a point close to the junction part before a leading end of the rod blocks the branch bore. A wet slurry made of a mixture of abrasives and water is jetted from a second open end of the main bore into the main bore by use of a squirt gun. The blast of wet slurry is collided with the leading end of the rod and redirected toward the branch bore to drive the abrasives against the junction part located inside the article for removal of burrs therefrom the junction part.

11 Claims, 6 Drawing Sheets

BLASTING METHOD FOR DEBURRING JUNCTION PART BETWEEN MAIN BORE AND BRANCH BORE

BACKGROUND OF THE INVENTION

1. Field of the Invention

This invention relates to a blasting method capable of effectively removing burrs from a junction part between a large-diameter main bore tubularly drilled through the body of an article, e.g. a component of a fuel feeding system of an internal combustion engine, and a small-diameter branch bore branching off at an angle from the main bore.

2. Description of Related Art

A member having a body 1 in a block form provided with a large-diameter main bore 2 and a small-diameter branch bore 3 branching off at an angle from the main bore 2 as illustrated in FIG. 1, is often used as a component of a fuel feeding system of an internal combustion engine, or the like. When the member is drilled for forming the branch bore 3 to join the main bore 2, the occurrence of burrs in a junction part 8 with the main bore 2 is inevitable, and therefore the removal of the burrs is needed in order for the member to be a finished product. However, the branch bore 3 is often of a small diameter insufficient for the insertion of a tool for deburring. This makes, in the existing conditions, it difficult to remove the burrs from the junction part 8. An electrolytic polishing technique is generally adopted for such deburring. However, this technique involves chemical agents and therefore requires an enormous amount of effort and time for the handling and disposal of the chemical agents with regard to environmental protection. Another attempted method includes a slurry blasting technique of blasting slurry made of a mixture of abrasives and water. In the conventional slurry blasting technique, however, the slurry merely passes linearly through the inside of the main bore 2, and hardly travels toward the small-diameter branch bore 3 which enters the main bore 2. This technique is insufficient to achieve the purpose of removing burrs from the junction part 8.

BRIEF SUMMARY OF THE INVENTION

The present invention has been made to solve the problems associated with the conventional process for removing burrs from a junction part between a large-diameter main bore and a small-diameter branch bore. It is an object of the present invention to provide a method for efficiently removing burrs from a junction part in a branch bore having a diameter size insufficient for insertion of a deburring tool.

According to the present invention, a method of a blast process for a junction part between a large-diameter main bore drilled through an article and a small-diameter branch bore branching off at an angle from the main bore, includes the steps of inserting a pillar-shaped rod from a first open end of the main bore to a point close to the junction part before a leading end of the rod blocks the branch bore; jetting a blast of a wet slurry made of a mixture of abrasives and water from a second open end of the main bore into the main bore by use of a squirt gun; and colliding the blast of the wet slurry with the leading end of the rod to redirect the blast of the wet slurry toward the branch bore to drive the abrasives against the junction part for removal of burrs from the junction part located inside the article. The rod may have a helical groove formed on its outer peripheral wall to produce a swirling motion in the blast of the wet slurry jetted into the main bore. A metal boring drill may be used as the rod.

With the method of the blast process performed on the junction part of the main bore and the branch bore formed inside the article in accordance with the present invention, a rod for controlling the direction of a blast of wet slurry is inserted in the main bore to efficiently guide the wet slurry to the junction part undergoing the blasting operation for creating the collision of the abrasives with the junction part. As a result, the blasting method has an advantage of effectively removing burrs from the junction part in the branch bore of an extremely small diameter, and especially, is of a high practical value in its application to small-sized precision components.

DETAILED DESCRIPTION OF THE INVENTION

Figure 1:
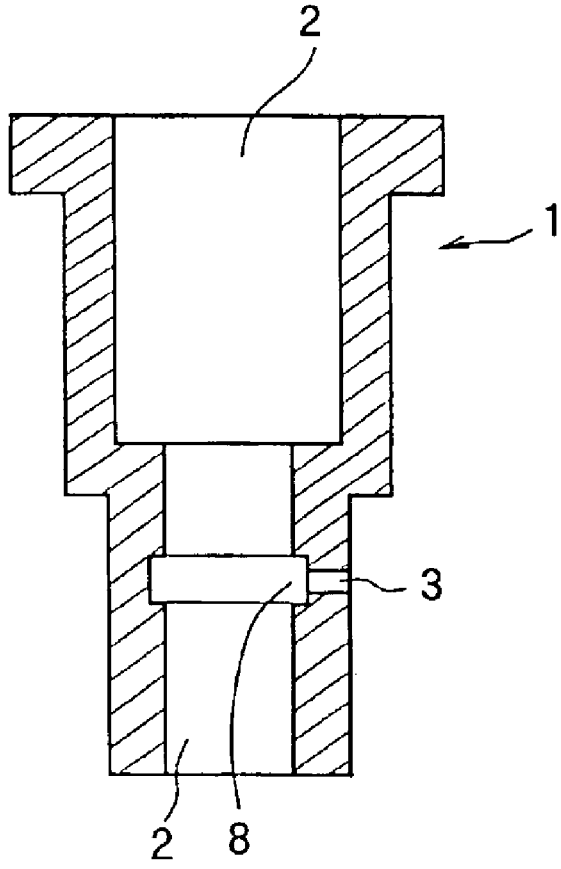
FIG. 1 is a sectional view of an example of articles conventionally undergoing a blast process, to which a blasting method according to the present invention is applied.

A preferred embodiment of a blasting method according to the present invention will be described below with reference to the accompanying drawings. The blasting method is conveniently applied to an article including a block-form body which has a large-diameter main bore tubularly drilled therethrough and a small-diameter branch bore branching off at an angle from the main bore inside the body as illustrated in FIG. 1. In FIGS. 2 to 5, the same reference numerals as those in FIG. 1 described earlier designate the same elements.

Figure 2:
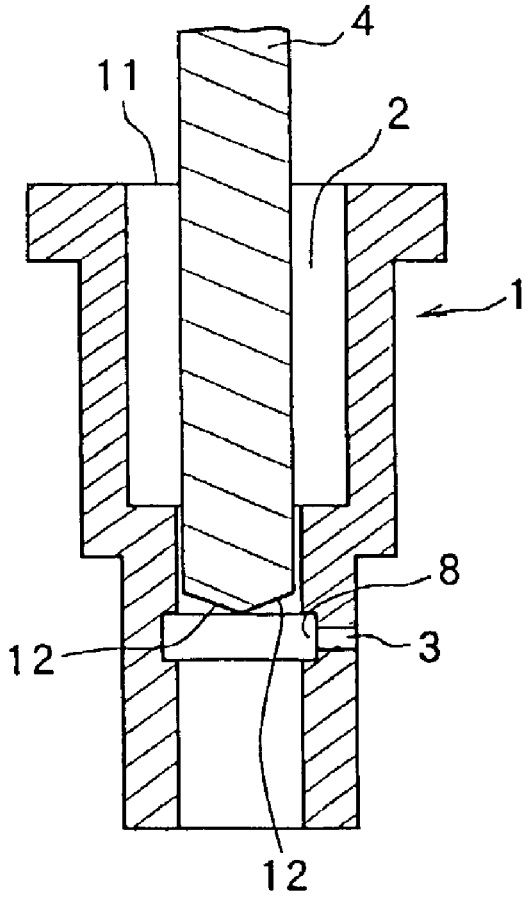
FIG. 2 is a sectional view illustrating the article with a rod 4 inserted therein in a blast process, using the blasting method according to the present invention.
Figure 6:
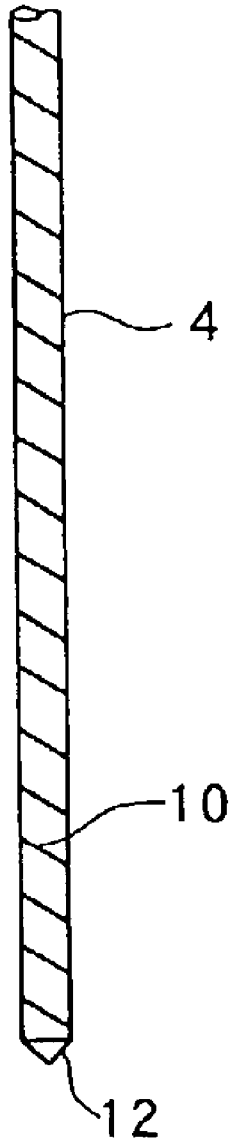
FIG. 6 is a front view illustrating an example of the rod 4 used in the present invention.

First, as illustrated in FIG. 2, a cylindrical rod 4 having an outer diameter slightly smaller than the inner diameter of a main bore 2 is inserted into the main bore 2 from an open end 11 of the tubular main bore 2 to a point in proximity to a junction part 8 with a branch bore 3 before a leading end 12 of the rod 4 blocks the branch bore 3 to be deburred (the upper part in FIG. 2). As illustrated in FIG. 6, the leading end 12 of the rod 4 is conical in shape, and the rod 4 has a helical groove 10 formed on its outer peripheral wall. The rod 4 is made of materials having a hardness which does not allow abrasives included in a wet slurry 7 described later to easily wear away the rod 4. A metal boring drill having a suitable diameter can be used as the rod 4.

Figure 3:
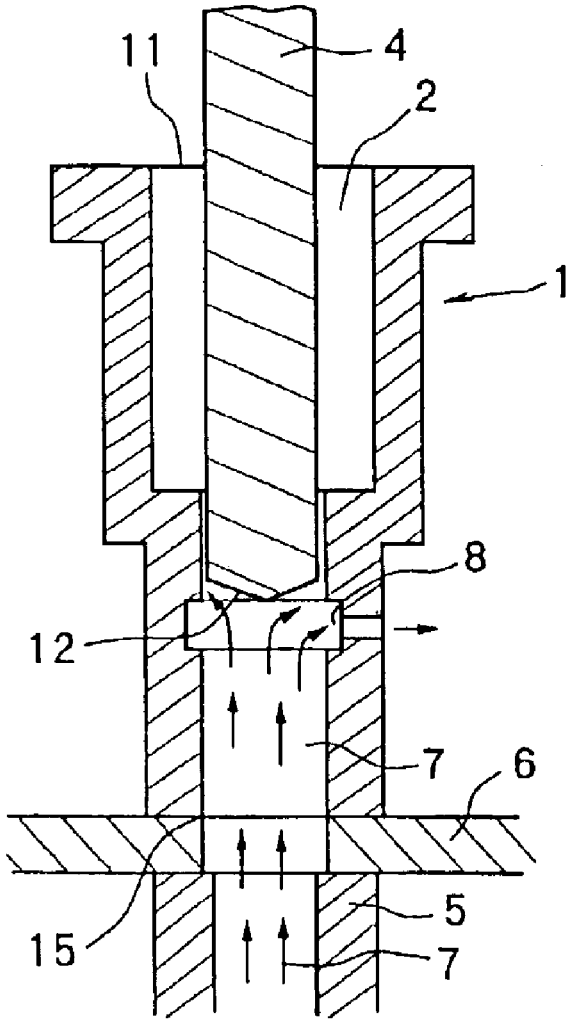
FIG. 3 is a sectional view illustrating the article with a nozzle 5 of a squirt gun applied thereto.

Then, as illustrated in FIG. 3, a nozzle 5 of a squirt gun is applied in intimate contact with the other open end 15 of the main bore 2 through a protector 6. The wet slurry 7 made of a mixture of abrasives and water is then jetted into the main bore 2. Note that the squirt gun itself is the same as that used in conventional blasting. The blast of wet slurry 7 comes into collision with the leading end 12 of the rod 4 which has been inserted in the main bore 2, and is redirected toward the junction part 8. Thus, the abrasives included in the wet slurry 7 travelling toward the junction part 8 strongly collide with burrs produced in the junction part 8, and exert their abrasive properties to remove the burrs for a smooth surface of the junction part 8.

A slight difference between the smaller outer diameter of the rod 4 and the larger inner diameter of the main bore 2 forms a void between the outer peripheral wall of the rod 4 and the inner peripheral wall of the main bore 2. Part of the wet slurry 7 passes through the void. The embodiment has the helical groove 10 formed in the outer peripheral wall of the rod 4 to provide a swirling motion for the blast of wet slurry 7 for further improvement in the blasting effect.

The formation of the helical groove 10 may not be absolutely necessary. If an adequate blasting effect can be expected without the helical groove 10, it is needless to say that the formation of the helical groove 10 may be omitted in consideration of costs and the like. It is possible to use a metal boring drill as the rod 4, in which case the drill is a suitable substitute for the rod 4, because the drill has an adequately high hardness and a helical groove 10 preformed thereon in light of its functions. In addition, a variety of drills with various diameters can be obtained as standard items in the market and are available everywhere at low prices.

Figure 4:
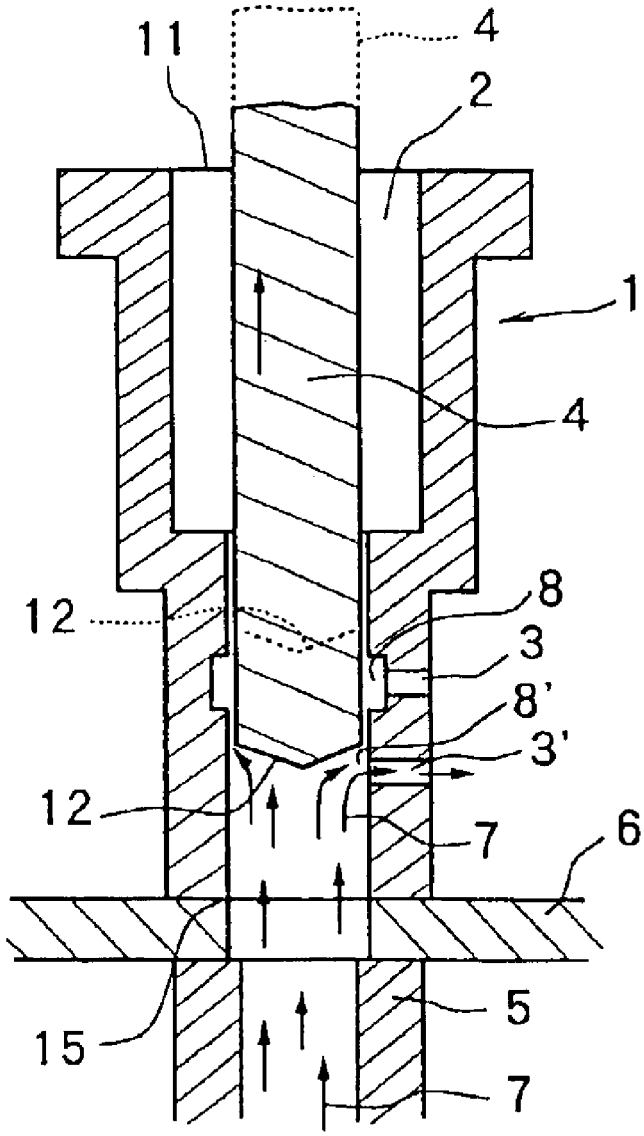
FIG. 4 is a sectional view illustrating a blast process for an article having a plurality of branch bores 3 and junction parts 8.
Figure 5:
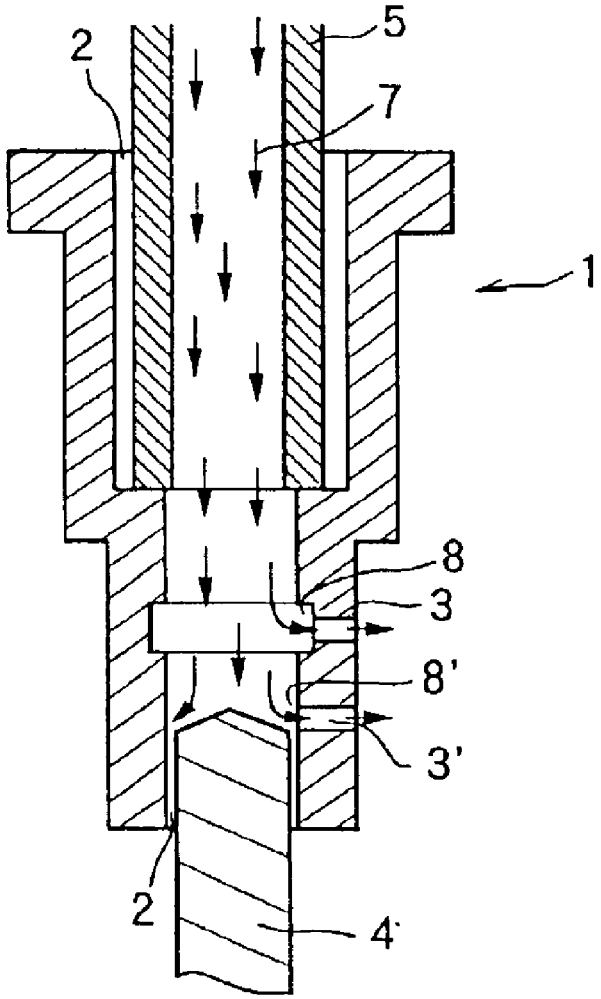
FIG. 5 is a sectional view illustrating the nozzle 5 of the squirt gun inserted into the main bore 2.

In the foregoing embodiment, the nozzle 5 of the squirt gun is not inserted inside the main bore 2. However, as illustrated in FIG. 5, the nozzle 5 of the squirt gun as well as the rod 4 may be inserted in the main bore 2 to blast the wet slurry 7. Further, when a plurality of branch bores 3 and 3' are formed in the body 1 as illustrated in FIG. 4, the amount of insertion of the rod 4 into the main bore 2 can be controlled such that the leading end 12 is positioned successively at points slightly upward of the respective branch bores 3 and 3' in order to perform one by one the operation of removing burrs from the respective junction parts 8 and 8'. If there is a change in diameter in the main bore 2 at some midpoint, a plurality of rods 4 having different outer diameters respectively corresponding to the inner diameters of the main bore 2 may be prepared and used in accordance with the position of the branch bore 3.

What is claimed is:

1. A blasting method for a junction between a large-diameter main bore in an article and a small-diameter branch bore branching off at an angle from the main bore in the article, comprising the steps of:

inserting a pillar-shaped rod from a first open end of the main bore with the leading end of the rod close to the junction without blocking the branch bore;

jetting a wet slurry made of a mixture of abrasives arid water from a blasting gun into the main bore from a second open end thereof;

colliding the wet slurry with the leading end of the rod to redirect the wet slurry toward the branch bore to drive the abrasives against the junction for removal of burrs located inside the article at the junction; and providing an outer peripheral wall of the rod with a helical groove to produce a swirling motion in the blast of the wet slurry jetted into the main bore.

2. A blasting method according to claim 1, wherein the wet slurry is jetted from outside the second open end of the main bore into the inside of the main bore by use of the blasting gun.

3. A blasting method according to claim 1, wherein a nozzle of the blasting gun is inserted into the main bore and the wet slurry is jetted into the main bore.

4. A blasting method according to claim 1, wherein the leading end of the rod has a substantially conical surface to assist in redirecting the jetted wet slurry toward the junction.

5. A blasting method for a junction between a large-diameter main bore in an article and a small-diameter branch bore branching off at an angle from the main bore in the article, comprising the steps of:

inserting a pillar-shaped rod from a first open end of the main bore with the leading end of the rod close to the junction without blocking the branch bore, wherein a metal boring drill is used as the rod;

jetting a wet slurry made of a mixture of abrasives and water from a blasting gun into the main bore from a second open end thereof; and colliding the wet slurry with the leading end of the rod to redirect the wet slurry toward the branch bore to drive the abrasives against the junction for removal of burrs located inside the article at the junction.

6. A blasting method according to claim 5, wherein the wet slurry is jetted from outside the second open end of the main bore into the inside of the main bore by use of the blasting gun.

7. A blasting method according to claim 5, wherein a nozzle of the blasting gun is inserted into the main bore and the wet slurry is jetted into the main bore.

8. A process for blasting a junction inside an article as defined between a large-diameter main bore drilled through the article and a small-diameter branch bore branching off at an angle from the main bore, comprising the steps of:

inserting an elongate rod into the main bore from a first open end thereof to a point where a leading end of the rod is close to the junction but does not block the branch bore;

jetting a wet slurry containing abrasives therein into the main bore from a second open end thereof;

impacting the jetted wet slurry against the leading end of the rod to redirect the jetted wet slurry toward the branch bore to drive the abrasives against the junction for removal of burrs located inside the article; and providing the leading end of the rod with a substantially conical surface to assist in redirecting the jetted wet slurry toward the junction.

9. A process according to claim 8, wherein the rod has a cross section which is only slightly smaller than the cross section of the main bore.

10. A process for blasting a junction inside an article as defined between a large-diameter main bore drilled through the article and a small-diameter branch bore branching off at an angle from the main bore, comprising the steps of:

inserting an elongate rod into the main bore from a first open end thereof to a point where a leading end of the rod is close to the junction but does not block the branch bore;

jetting a wet slurry containing abrasives therein into the main bore from a second open end thereof;

impacting the jetted wet slurry against the leading end of the rod to redirect the jetted wet slurry toward the branch bore to drive the abrasives against the junction for removal of burrs located inside the article; and providing the leading end of the rod with a substantially conical surface to assist in redirecting the jetted wet slurry toward the junction, wherein a metal boring drill is used as the rod.

11. A process for blasting a junction inside an article as defined between a large-diameter main bore drilled through the article and a small-diameter branch bore branching off at an angle from the main bore, comprising the steps of:

inserting an elongate rod into the main bore from a first open end thereof to a point where a leading end of the rod is close to the junction but does not block the branch bore;

jetting a wet slurry containing abrasives therein into the main bore from a second open end thereof;

impacting the jetted wet slurry against the leading end of the rod to redirect the jetted wet slurry toward the branch bore to drive the abrasives against the junction for removal of burrs located inside the article;

providing the leading end of the rod with a substantially conical surface to assist in redirecting the jetted wet slurry toward the junction; and providing an outer peripheral wall of the rod with a helical groove to produce a swirling motion in the wet slurry jetted into the main bore.

* * * * *